US007758722B2

(12) United States Patent
Saueressig

(10) Patent No.: US 7,758,722 B2
(45) Date of Patent: Jul. 20, 2010

(54) PRODUCTION METHOD FOR AN ABSORBENT FIBER PRODUCT AND CORRESPONDING ABSORBENT FIBER PRODUCT

(75) Inventor: Kilian Saueressig, Vreden (DE)

(73) Assignee: Saueressig GmbH + Co., Vreden (DE)

( * ) Notice: Subject to any disclaimer, the term of this patent is extended or adjusted under 35 U.S.C. 154(b) by 861 days.

(21) Appl. No.: 10/549,765

(22) PCT Filed: Mar. 9, 2004

(86) PCT No.: PCT/DE2004/000452

§ 371 (c)(1),
(2), (4) Date: Jan. 11, 2007

(87) PCT Pub. No.: WO2004/083523

PCT Pub. Date: Sep. 30, 2004

(65) Prior Publication Data

US 2007/0160835 A1 Jul. 12, 2007

(30) Foreign Application Priority Data

Mar. 21, 2003 (DE) ..... 103 12 758

(51) Int. Cl.
*D21C 5/00* (2006.01)

(52) U.S. Cl. ..... 162/50; 162/52; 162/63; 162/101; 162/115; 162/123

(58) Field of Classification Search ..... 162/192, 162/50, 52, 63, 101, 115, 123, 188
See application file for complete search history.

(56) References Cited

U.S. PATENT DOCUMENTS 3,977,089 A * 8/1976 Forster et al. ..... 34/264
5,037,663 A * 8/1991 Dale ..... 426/69
2005/0145353 A1* 7/2005 Troxell et al. ..... 162/118

FOREIGN PATENT DOCUMENTS

| | | |
|---|---|---|
| DE | 196 39 491 A | 4/1998 |
| EP | 0 671 504 A | 9/1995 |
| EP | 0 989 231 A | 3/2000 |

OTHER PUBLICATIONS

NASA, Phil Newman, Regions of the Electromagnetic Spectrum, found on Oct. 29, 2009 at: http://imagine.gsfc.nasa.gov/docs/science/know_l1/spectrum_chart.html.*
International Search Report.

* cited by examiner

*Primary Examiner*—Eric Hug
*Assistant Examiner*—Jacob Thomas Minskey
(74) *Attorney, Agent, or Firm*—Paul, Hastings, Janofsky & Walker LLP

(57) ABSTRACT

The invention relates to a method for producing an absorbent fiber product, starting with a parent fiber product that comprises fibers that, on the one hand, lie at a statistical distance from one another and, on the other hand, make contact with one another at contact points. The method comprises treating the parent fiber product with a fluid medium in such a way that the fibers are at least partially wetted and the fluid medium is then rapidly evaporated by irradiation, so that the evaporation pressure generated by the evaporating fluid medium has a kinematic effect on the fibers, which increases the distance between them. In this way the risk of inadvertent, in particular, thermal damage to the fibers is eliminated. Furthermore, the intrinsic fiber structure is left unaffected, or is only affected in a controlled manner. This prevents the uncontrolled destruction of the fiber structure and a detrimental effect on the fiber product, for example, to its tear resistance when wet. Instead, the proposed method achieves an expansion of the fiber product on a microscopic scale by increasing the distance between the fibers. In a further embodiment, the intrinsic fiber structure can be controlled and affected in a targeted manner if necessary, by controlling the time period between the wetting of the fibers and the evaporation of the fluid medium.

15 Claims, No Drawings

PRODUCTION METHOD FOR AN ABSORBENT FIBER PRODUCT AND CORRESPONDING ABSORBENT FIBER PRODUCT

CROSS-REFERENCES TO RELATED APPLICATIONS

This application is the national phase of International Patent Application No. PCT/DE2004/000452, filed Mar. 9, 2004, which claims priority to German Patent Application No. 10312758.5, filed Mar. 21, 2003, which is herein incorporated by reference in its entirety.

BACKGROUND

1. Field of the Invention

The invention relates to a method for producing an absorbent fiber product, according to which a parent fiber product that comprises fibers that, on the one hand, lie at a statistical distance from one another and, on the other hand, make contact with one another at contact points, is treated to have enhanced properties, such as greater absorbency and increased softness. The invention also relates to a corresponding absorbent fiber product produced in accordance with this method.

2. Background of the Invention

Fiber products such as hygiene products or so-called nonwoven products like paper used for paper toweling, toilet paper and tissues etc. are very absorbent. The absorbency capability of a fiber product determines its quality and value. The prevailing types of fiber used are, for example, chemical wood pulp.

The absorbency capability of a fiber product is essentially determined by the unrestricted volume achieved by such a fiber product. In this connection, the arrangement of the fibers which, on the one hand, lie at a statistical distance from one another and, on the other hand, make contact with one another at contact points, is of importance. The interstitial space between the fibers can absorb liquids of all kinds. The absorbency capability of the fiber itself also plays a role.

Other well-known methods for the production of absorbent fiber products concentrate on producing a fiber product with absorbency capabilities that rely on the above mentioned arrangement of the fibers as well as the characteristics of the fibers themselves during the production process. Up until now, no additional means exist that can increase the absorbency capability of fiber products thus taking into consideration the specific characteristics of fiber products.

EP 0 671 504 A1 relates to a method for the production of foam material from waste paper and the like which as a liquid, preferably, watery pulp is heat treated as the pulp is exposed to microwave radiation so that the paper pulp is expanded from the resulting steam and is left in a porous state.

EP 0 989 231 A2 relates to a method for setting the moisture profile of a drying fiber web whereby the fact that water absorbs more high frequencies and/or microwaves than dry paper or its fibers do, is taken advantage of.

DE 196 39 491 C2 describes the enlargement of the surface of particles such as granulate or powder, for example, concrete fragments so that, at least to a limited extent, particles that absorb liquid are subjected to a liquid or its humid atmosphere until the liquid has penetrated at least into the surface area of the particle but preferably to the core. Subsequently, the liquid containing particles are radiated with microwaves until the penetrated liquid is rapidly evaporated and the particle structure bursts open. This method is mostly suitable for hard particle structures and the result of the method is burst particles as the liquid within the particle is evaporated.

As opposed to loose particles that lie next to each other, a fiber product consists of a conglomerate of fibers which because of their characteristics stick together and hold together the conglomerate as, for example, paper. On the one hand, the fibers lie at a statistical distance from one another and, on the other hand, make contact with one another at contact points.

The implementation of the above described method using fiber products of the type described above would render the fiber product unusable and would at the very least have detrimental drawbacks since the fiber structure and the conglomerate would be destroyed or burst in an uncontrolled manner. Furthermore, the intensive irradiation would thermally affect the fibers used in the fiber product and would thermally damage the fiber material which only appears to superficially increase absorbency. Lasting damage to the fiber would result in a rough paper product that would disintegrate easily when wet, which would render the fiber product less absorbent and virtually useless.

No production method is known that tries to advantageously influence the absorbency capabilities of fiber products after production. A production method that would largely eliminate the unwanted thermal damage to the fiber material but that also would significantly increase absorbency of an absorbent fiber product is needed.

BRIEF SUMMARY OF THE INVENTION

The present invention provides a production method for an absorbent fiber product whereby the absorbency capabilities of a fiber product are improved compared to the initial absorbency capability of the parent fiber product. The present invention further relates to an absorbent fiber product that is produced in accordance with this method. According to a production method of the the invention, a parent fiber product is obtained which comprises fibers that, on the one hand, lie at a statistical distance from one another and, on the other hand, make contact with one another at contact points. The parent fiber product is treated with a fluid medium in such a way that the fibers are at least partially wetted, and the fluid medium is rapidly evaporated by irradiation between the fibers, e.g., by microwave radiation, so that the evaporation pressure generated by the evaporating fluid medium has a kinematic effect on the fibers, which increases the distance between them, and achieves an expansion of the fiber product on a microscopic scale. Known forms of fluid media may be used, for example, the fluid medium may be in the form of a vapor or an emulsion. The method avoids thermal damage to the fibers and leaves the intrinsic fiber structure unaffected or only affected in a controlled manner, thereby preventing the uncontrolled destruction of the fiber structure and a detrimental effect on the fiber product, for example, to its tear resistance when wet. The invention further provides a method by which the intrinsic fiber structure can be controlled and affected in a targeted manner, if necessary, by controlling the time period between the wetting of the fibers and the evaporation of the fluid medium. Fiber products of the invention have increased absorbency and greater softness than fibers produced by conventional fiber production methods, and are well-suited for use as hygiene fiber products such as paper toweling, toilet paper, and tissues.

BRIEF DESCRIPTION OF THE DRAWINGS

Not Applicable

DETAILED DESCRIPTION OF THE INVENTION

As used herein, the term "parent fiber product" refers to a fiber product that comprises fibers that, on the one hand, lie at a statistical distance from one another and, on the other hand, make contact with one another at contact points. The present invention provides a production method according to which a parent fiber product is treated with a fluid medium in such a way that the fibers are at least partially wetted, and the fluid medium is rapidly evaporated by irradiation between the fibers, so that the evaporation pressure generated by the evaporating fluid medium has a kinematic effect on the fibers, which increases the distance between them.

The invention takes into consideration the observation that an initial absorbency capability of a parent fiber product within the scope of an ordinary production method is limited by the usual mechanical influences on the parent fiber product within the framework of the normal production process. The invention recognizes that the initial absorbency capability mainly is determined by the statistical distance between the fibers in the parent fiber product. The conclusion of the observations of the invention thus is that as the distance between the fibers is increased the initial absorbency capability is also greatly increased. To this end, the fibers are superficially wetted by the fluid medium. Thermal damage to the fibers themselves from the irradiation which would have significantly compromised the tear strength is avoided. However, the invention also reveals that by exposing the surface of the fiber to a fluid medium and to massive irradiation, undesired influence on the fibers themselves is largely avoided. Therefore, the inventive method ensures that after at least partial wetting of the fibers the irradiation predominantly affects the fluid medium as the irradiation rapidly evaporates the fluid medium. In accordance with the inventive method, a sufficiently rapid evaporation of the fluid medium will generate such strong evaporation pressure or partial pressure that it has a kinematic effect on the fibers. The main effect of this is that the distance between the fibers increases. Thus, the actual statistical distance between each fiber is on average increased.

In accordance with a method of the invention, as the fluid medium evaporates it widens the accumulation of fibers in the fiber product. This leads to a surface enlargement of the fiber product on a microscopic scale as the distance between the fibers, on average, is increased. Firstly, the fibers are superficially wetted with the fluid medium whereby uncontrolled infiltration by way of diffusion of the fluid medium into the fibers, as such, is prevented. Undesired impact on the fibers themselves is thus entirely avoided.

A method of the invention introduces fluid medium in between the fibers, and the fluid medium is then evaporated in the interstitial spaces between the fibers. Correspondingly, the pressure generated by the evaporation works between the fibers and increases the distance between the fibers relative to each other. In a first embodiment of the invention, the fibers can exclusively be superficially wetted and even a penetration of the fluid medium into the surface of the fibers is avoided. An alternative embodiment of the invention provides for affecting the fibers themselves within the framework of a controlled step in which the diffusion of the fluid medium into the fibers is controlled and, as necessary, is permitted to a limited extent. Both embodiments may be implemented as needed using suitable fluid media, suitable surface tension and/or volatility and/or viscosity and/or diffusion times when wetting a specific fiber, and they are both described in further detail below.

The proposed method has significant advantages during production of the fiber product itself. The conventional production method can be considerably simplified, firstly, because the structure of the fiber product does not have to be considered, since in accordance with the above described further embodiment the fiber product is subsequently expanded. Furthermore, there are significant advantages for the fiber product itself which, in particular, will be beneficial for hygiene fiber products such as paper toweling, toilet paper or tissues. Less fiber material is needed to achieve an equal absorbency rate when using the proposed production method than would have been necessary using the conventional fiber production methods. This fact bears with it both ecological and economical advantages. Furthermore, the fiber product resulting from the proposed production method is softer than the usual fiber products thanks to the loosened surface.

Preferred embodiments of the invention are described below. These offer advantageous means of delivering the fluid medium into the parent fiber product and/or means of making the evaporation process more effective.

In regards to the treatment of the parent fiber product with the fluid medium, the parent fiber product can be exposed to vapor deposition and/or vapor saturation with the fluid medium in the form of vapor. The method may be performed by simply vaporizing the fiber product since, depending on the intended use, such vapor deposition would achieve a partial wetting of the surface of the fiber. Alternatively, an intensive vapor saturation of the parent fiber product may, as necessary, also be performed.

Additionally or alternatively, the parent fiber product may be wetted and/or saturated by the fluid medium in the form of an emulsion.

Depending on the need, the fibers can be homogeneously wetted with the fluid medium in performing the method of the two examples described above; e.g., by intensively vapor saturating or saturating the parent fiber product.

In one embodiment of the invention, the kinematic effect on the fibers in the fiber product compacts the fibers on the contact points. This result occurs when the distance between the fibers increases as the fibers move away from each other and they thus compact at the statistical contact points and/or junction points. The compaction at the contact points and/or junction points results in a smaller surface to volume ratio. At those locations, fluids are thus absorbed slower than at other locations. This positively affects the tear resistance of the wet parent fiber product treated in accordance with the proposed production method.

The rapid evaporation of the fluid medium in the subsequent step can be effected by microwave radiation. In an embodiment characterized by the use of high power density, the fibers are exposed to microwave radiation within a short exposure time in a rather high energetic area with high power density. In this connection, it is useful to use microwave radiation with wavelengths of between 1000 nm and 1000 μm, with high energy microwave radiation with shorter wavelengths being preferable. It is preferable to choose microwave radiation with wavelengths that are absorbed less by the fibers than by the fluid media. In this way undesired thermal damage to the parent fiber product is avoided since the irradiation virtually only affects the fluid medium. In accordance with the method, the irradiation does not affect the fibers themselves directly but rather indirectly by way of the kinematic effect resulting from the high evaporation pressure caused by the evaporating fluid medium.

Preferably, the exposure time during irradiation should be short. On an industrial scale an exposure time between 1 μs and 1000 ms suffices. In this connection, continuous microwave radiation is assumed. However, the method of the invention can also be performed using pulsed microwave radiation comprising pulse lengths in the area of ns or less. Particularly high power density can be achieved using pulsed microwave radiation. To achieve the above described kinematic effect on the parent fiber product, power densities of between $10^3$ and $10^6$ W/mm$^2$ are preferable, when using pulsed or continuous microwave radiation or any other type of irradiation. Such power densities are greater than those used for conventional microwaves which reach between 10 and 100 W/mm$^2$. This difference in power density leads to an almost explosive evaporation of the fluid medium within the parent fiber product which then leads to the above described kinematic effect on the fibers. Such great power density can be achieved mainly by employing a high-performance irradiation source and corresponding precise focusing of the irradiation. These principles are valid for all types of irradiation. Microwave radiation is particularly suitable since absorption is high for the aqueous or vaporous forms of the fluid medium while it remains comparatively low for common fibers.

In another embodiment of the production method of the invention, an additional step provides for the control of the time period between, on the one hand, the wetting of the fibers as the parent fiber product is treated with the fluid medium and, on the other hand, the rapid evaporation of the fluid medium by irradiation. In this manner, the scope of a diffusion of the fluid medium is directed between and/or, if necessary, into the fibers. Depending on the type of vapor deposition and the type of vapor medium used, this embodiment achieves, in addition to the kinetic effect between the fibers, a targeted influence of the fiber structure while avoiding inadvertent thermal damage or the destruction of the fibers. As opposed to other well-known methods which comprise bursting particles, depending on the surface energy of the fluid medium/vapor deposition medium, the present embodiment also ensures that the medium will tend to bind exclusively to the fibers, wetting only the surface without penetrating them. If necessary, the fluid medium can also be permitted to diffuse into the fibers. Since this process is determined by well-known time frames the amount of fluid (vapor deposition) medium that binds to the fiber or is inside the fiber can be adjusted for exactly. In this manner, the specified time period ensures that the fibers are only wetted on the surface, or in other words, ensures that the fluid medium binds only to the surface of the fiber and fills the interstitial spaces of the fibers. If necessary, a longer time period may be chosen so that a greater or smaller part of the fluid medium infiltrates the fiber allowing for controlled and targeted effect on the fiber structure during subsequent rapid evaporation of the fluid medium. The evaporation pressure generated by evaporating the fluid medium can thus generate in the fiber fissures. Such fissures appear as changes in the fiber structure of the fiber product and may be employed for additional moisture or fluid absorption. The time period is kept short in a controlled manner to always prevent bursting or complete destruction of the fiber. The detrimental thermal effect on the fiber structure is also avoided with this additional embodiment.

In connection with the above described embodiment of the method, a subsequent step may be added to stabilize the fiber structure whereby subsequent to the evaporation of the fluid medium, the parent fiber product is treated with a fluid fixative. This fluid fixative may be introduced to the loosened fiber structure either during wetting/saturation or vapor deposition/vapor saturation and will stabilize and fuse the loosened structure.

The invention can be used to produce absorbent fiber products belonging to the hygiene product group, such as paper toweling, toilet paper and tissues, and includes such fiber products that are produced by the method disclosed herein.

The invention specifications disclosed above as well as in the patent claims could be significant both individually and in any chosen combination for the different implementations of the invention.

The foregoing disclosure of the preferred embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

The invention claimed is:

1. A method for producing an absorbent fiber product comprising:

treating a parent fiber product with a fluid medium such that fibers of the parent fiber product are at least partially wetted, and rapidly evaporating the fluid medium by microwave irradiation between the fibers, so that evaporation pressure generated by the evaporating fluid medium has a kinematic effect on the fibers, which increases the distance between the fibers, wherein power density of the pulsed microwave radiation is between approximately $10^3$ and approximately $10^6$ W/mm$^2$.

2. The method of claim 1, wherein the parent fiber product is exposed to a fluid medium in a form selected from vapor and emulsion.

3. The method of claim 2, wherein the parent fiber product is exposed to at least one of vapor deposition and vapor saturation by the fluid medium in the form of vapor.

4. The method of claim 2, wherein the parent fiber product is one of wetted and saturated by the fluid medium in the form of an emulsion.

5. The method of claim 2, wherein the fibers are homogeneously wetted.

6. The method of claim 1, wherein the fibers contact each other at contact points, and wherein the kinematic effect on the fibers compacts the fibers at the contact points.

7. The method of claim 1, wherein the fibers are subjected to pulsed microwave radiation.

8. The method of claim 1, wherein the microwave radiation comprises wavelengths of approximately 1000 um.

9. The method of claim 1, wherein the microwave radiation comprises wavelengths that are absorbed less by the fibers than by the fluid media.

10. The method of claim 1, wherein exposure time of the pulsed microwave radiation is between approximately 1 μs and approximately 1000 ms.

11. The method of claim 1, further comprising adjusting a time period between the wetting of the fibers with the fluid medium and the rapid evaporation of the fluid medium so that diffusion of the fluid medium is directed towards at least one of in between and into the fibers.

12. The method of claim 1, further comprising treating, subsequent to the rapid evaporation of the fluid medium, the parent fiber product with a fluid fixative.

13. A method for producing an absorbent fiber product, comprising contacting a parent fiber product with a fluid medium such that fibers of the parent fiber product are at least partially wetted, and irradiating the fibers, so that the fluid medium between the fibers is rapidly evaporated and an absorbent fiber product is produced that has greater absorbency than the parent fiber product, wherein power density of the irradiation is between approximately $10^3$ and approximately $10^6$ W/mm$^2$.

14. The method of claim 13, wherein the parent fiber product is exposed to a fluid medium in a form selected from vapor and emulsion.

15. The method of claim 13, wherein the fibers are homogeneously wetted.

* * * * *